United States Patent [19]

Andersson et al.

[11] 4,341,597

[45] Jul. 27, 1982

[54] FIBROUS MATERIAL HAVING GOOD DIMENSIONAL AND HEAT STABILITY

[75] Inventors: Arne Andersson, Skovde; Jan Emanuelsson, Stenungsund; Ingemar Johansson, Stenungsund; Svante Wahlen, Stenungsund, all of Sweden

[73] Assignee: Rockwool AB, Skovde, Sweden

[21] Appl. No.: 146,901

[22] Filed: May 5, 1980

[30] Foreign Application Priority Data

May 4, 1979 [SE] Sweden ..... 7903928

[51] Int. Cl.[3] ..... D21H 1/40; D21H 3/02

[52] U.S. Cl. ..... 162/127; 162/135; 162/136; 162/145; 162/158; 162/164.3; 162/168.1; 428/159; 428/288; 428/290; 428/316.6; 428/507; 428/514; 428/537

[58] Field of Search ..... 162/127, 135, 136, 145, 162/152, 158, 168 R, 169, 182; 428/159, 288, 290, 316.6, 507, 514, 537

[56] References Cited

U.S. PATENT DOCUMENTS 2,615,806 10/1952 Marsh et al. ..... 162/145
3,674,632 7/1972 Wennergren et al. ..... 162/168 R

FOREIGN PATENT DOCUMENTS 50-101602 8/1975 Japan ..... 162/158
54-11313 1/1979 Japan ..... 162/158

*Primary Examiner*—Peter Chin

[57] ABSTRACT

Fibrous material is provided comprising cellulose fibers and mineral wool fibers in a weight ratio within the range from about 3:7 to about 10:1, impregnated with an amount of a water-soluble polyoxyalkylene ether alcohol sufficient to impart dimensional stability thereto and having the formula:

$$R_1[-O-(C_{n1}H_{2n1}-O)_x-C_{n2}H_{2n2}-OH]_m$$

wherein:

$R_1$ is hydrocarbon or hydrocarbon substituted with secondary hydroxyl groups and free from primary hydroxyl groups and having from one to about twenty-four carbon atoms;

m is a number within the range from 1 to about 6;

$n_1$ is a number within the range from about 2 to about 4;

$n_2$ is a number within the range from 3 to 4; and $-C_{n2}H_{2n2}-OH$ is a branched chain propylene or butylene group having only secondary OH groups; and the total of x in all of the m groups (x multiplied by m) is a number within the range from about 2 to about 200; and optionally also impregnated with a plastic material.

16 Claims, No Drawings

FIBROUS MATERIAL HAVING GOOD DIMENSIONAL AND HEAT STABILITY

Fibrous material composed of a mixture of cellulose fibers and mineral wool fibers and containing a polyethylene glycol imparting dimensional stability thereto has been impregnated with plastic materials to obtain, among other things, floor coverings such as carpets and rugs. The plastic material is usually applied by impregnation, and the impregnated material can then be heated to obtain a smooth and homogeneous coating on the fibrous material, at the same time curing the plastic material, if necessary.

If a blowing agent is added to the plastic material that expands when the impregnated material is heated, a foamed coating will be obtained. The foaming can be confined to selected regions by including in these regions of the coating composition, or a coating thereon such as a printing paste, a blowing inhibitor which inhibits the decomposition of the blowing agent.

Suitable plastic materials include thermoplastic polymers, preferably derived from vinyl monomers, such as vinyl chloride, which can be homopolymerized or copolymerized with other copolymerizable vinyl or other monomers, such as vinyl acetate and vinylidene chloride. A preferred homopolymer coating material is polyvinyl chloride, which can be used in the form of a plastisol together with a plasticizer, and, if desired, a blowing agent, and an accelerator for the blowing.

The plastic material, blowing agent and accelerator can be impregnated on the fibrous material and then heated to obtain a preliminary set of the coating on the fibrous material, after which a color printing paste can be applied, according to a selected decorative pattern. Some color printing pastes contain blowing inhibitors or blowing accelerators, which give either a lesser or an increased foaming in the areas of the coating in contact with the paste. The treated fibrous material can then be placed in an oven and finally cured at a temperature within the range from about 170° to about 200° C., while the foaming takes place at the same time. In the areas where a blowing inhibitor is present, the foaming is reduced, different from the areas where the inhibitor is not present, and a relief pattern in the coated fibrous material is obtained as a result.

When polyethylene glycol is used as a dimension-stabilizing agent with fibrous materials composed of cellulose fibers and mineral wool fibers in a weight ratio within the range from about 3:7 to about 10:1, the plastic coating is often of poor quality, exhibiting an undesirable blistering and an irregular thickness, as well as a tendency for the coating material to become detached from the fibrous material. Moreover, the relief pattern is frequently shallow, and lacks a sharp delineation between the adjacent portions of the foamed material. Why these difficulties occur is not known, but of course it is desirable to overcome them.

In accordance with the present invention, it has been found possible to eliminate these difficulties by employing as the dimension-stabilizing compound a water-soluble polyoxyalkylene ether alcohol having the general formula:

$$R_1[-O-(C_{n1}H_{2n1}-O)_x-C_{n2}H_{2n2}-OH]_m \qquad \text{I.}$$

wherein:

$R_1$ is hydrocarbon or hydrocarbon substituted with secondary hydroxyl groups and free from primary hydroxyl groups and having from one to about twenty-four carbon atoms;

m is a number within the range from 1 to about 6;

$n_1$ is a number within the range from about 2 to about 4;

$n_2$ is a number within the range from 3 to 4; and $-C_{n2}H_{2n2}-OH$ is a branched chain propylene or butylene group having only secondary OH groups; and the total of x in all of the m groups (x multiplied by m) is a number within the range from about 2 to about 200; and optionally also impregnated with a plastic material.

The amount of polyoxyalkylene ether alcohol is normally within the range from about 1 to about 30%, and preferably within the range from about 2 to about 20%, by weight based on the total weight of the cellulose fibers and mineral wool fibers in the fibrous material.

Preferred compounds falling within the above formula have x within the range from about 6 to about 50, and m within the range from 1 to about 4.

Particularly preferred compounds are those having the formula:

$$R_1-O-(C_{n1}H_{2n1}-O)_x-CH_2-\underset{\underset{CH_3}{|}}{CH}-OH \qquad \text{II.}$$

wherein $R_1$, $n_1$ and x are as above.

In a further preferred embodiment, the water-soluble polyoxyalkylene ether alcohol has the formula:

$$R_1[O-(\underset{\underset{CH_3}{|}}{CH_2CH}-O-)_xCH_2\underset{\underset{CH_3}{|}}{CH}-OH]_{m1} \qquad \text{III.}$$

wherein:

$m_1$ is a number within the range from 3 to 6;

$R_1$ is derived from a polyol having at least three up to about six hydroxyl groups, preferably glycerol, and the $R_1$ group if containing hydroxyl groups has only secondary hydroxyl and no primary hydroxyl groups; and x is as above.

In the preferred embodiments of the invention, the fibrous material is coated by any desired procedure with a plastic material. Exemplary plastic materials include thermoplastic synthetic polymers derived from vinyl monomers, such as vinyl chloride, vinyl acetate, vinylidene chloride and copolymers thereof with two or more monomers, such as polyvinyl chloride, copolymers of vinyl chloride and vinyl acetate, polyvinylidene chloride, copolymers of vinylidene chloride and vinyl chloride, copolymers of vinyl alcohol and vinyl acetate, polyvinyl acetate, and partially hydrolyzed polyvinyl acetate (polyvinyl alcohol). Polyvinyl chloride is a preferred material. Also useful thermoplastic resins include polyamides, polyolefins, such as polyethylene, polypropylene and polyisobutylene, polyesters, polyvinyl butyral, polyacrylonitrile and polyimides.

Polyvinyl chloride coatings are normally prepared from conventional polyvinyl chloride plastisols containing a plasticizer, such as dioctylphthalate or butyl benzylphthalate, in a weight ratio polymer:plasticizer within the range from about 2:3 to about 5:1, and preferably from about 1:1 to about 3:1, together with additives, such as, for example, blowing agents, for instance azodicarbonamide, and an accelerator, such as, for example, zinc oxide. Blowing inhibitors such as trimellitic acid anhydride are usually added in the course of inking-in of the desired color pattern, so that the portions where the ink is applied do not blow to the same volume as the portions not bearing ink, thus giving a relief pattern on the coated fibrous material. Accelerators can also be present during blowing. It is also possible to obtain relief coatings by calendering. Many processes for the coating of fibrous materials with plastic materials, such as polyvinyl chloride, are disclosed in the literature, and any known coating procedure can be used, according to the selected objectives.

The polyoxyalkylene ether alcohols of the invention can be prepared by reacting monohydric or polyhydric alcohols or other polyfunctional hydroxy-substituted compounds having from about one to about twenty-four carbon atoms with an alkylene oxide having from about two to about four carbon atoms and mixtures thereof. The alkylene oxide has a branched chain if it has three or four carbon atoms, such as 1,2-propylene oxide, 1,2-butylene oxide, 2,3-butylene oxide, and 1,2-butylene oxide. The product is a polyoxyalkylene ether with one or two terminal secondary hydroxy groups and no primary hydroxyl groups, in which $R_1$ is the organic residue of the alcohol, and $[C_{n1}H_{2n1}O]$ the residue of the alkylene oxide.

If the polyoxyalkylene ether alcohol has a terminal hydroxyethyl group, since this has a primary hydroxyl group it is extinguished by reaction with a branched chain alkylene oxide having from three to four carbon atoms, thus providing a terminal secondary hydroxypropylene or secondary hydroxybutylene group on the compound instead, i.e., the $-C_{n2}H_{2n2}OH$ group.

Exemplary monohydric aliphatic alcohols include methanol, ethanol, propanol, butanol, hexanol, octanol, decanol, dodecanol (lauryl alcohol), myristyl alcohol and cetyl alcohol.

Exemplary monohydric cycloaliphatic alcohols include cyclohexanol, cyclopropanol, cycloheptanol and cyclooctanol.

Exemplary aromatic or phenolic hydroxy compounds include octyl phenol, nonyl phenol, decyl phenol, stearyl phenol, di(octyl) phenol and di(nonyl) phenol.

Exemplary polyfunctional hydroxy-substituted compounds, i.e., polyols, include glycerol, trimethylol propane, triethylol propane, butylene glycol, butylene triol, hexylene triol, pentaerythritol, erythritol, neopentyl glycol, sorbitol, mannitol, sugar alcohols or polysaccharides, cyclohexane diol, cyclohexane triol, hexahydroxy cyclohexane, oricinol, resorcinol, pyrogallol, phloroglucinol and hydroquinone.

Thus, $R_1$ when a hydrocarbon group can, for example, be methyl, ethyl, propyl, isopropyl, butyl, isobutyl, pentyl, isopentyl, hexyl, isohexyl, tertiary hexyl, heptyl, octyl, 2-ethyl hexyl, isooctyl, nonyl, decyl, undecyl, lauryl, myristyl, palmityl and stearyl, eicosyl and behenyl.

When $R_1$ is derived from a polyol and all of the hydroxyl groups of the polyol are reacted with alkylene oxide as indicated, $R_1$ is a hydrocarbon group, but polyvalent, the number of hydroxyls replaced being represented by the number m or $m_1$ in the general formulae above. Ethylene, propylene, butylene, pentylene, neopentylene, cyclohexylene and phenylene are exemplary such $R_1$ hydrocarbon groups.

If not all of the hydroxyl groups are substituted with alkylene oxide, the resulting product is an alcohol, a mono- ol or polyol, and $R_1$ is a secondary hydroxyl-substituted hydrocarbon group. There can be from one to the total of hydroxyl groups in the starting polyol minus one. Thus, for example, if only one hydroxyl group of glycerol be substituted, the final product is a polyoxyalkylene ether or glyceryl glycol. If two of the hydroxyl groups of the glycerol be reacted, the final product is a polyoxyalkylene glyceryl monoalcohol. If the polyol has four hydroxyl groups, m or $m_1$ can have values ranging from one to four, with the number of hydroxyl groups ranging from none to three. If the polyol has six hydroxyl groups, m and $m_1$ can range from one to six, and there can be from none to five hydroxyl groups in the polyoxyalkylene compound. All of these hydroxyl groups must however be secondary, and any primary hydroxyl groups extinguished, such as by reaction with a branched chain propylene or butylene oxide.

Another class of preferred polyoxyalkylene ether alcohols in accordance with the invention have the general formula:

$$HO-C_{n2}H_{2n2}[-O-(C_{n1}H_{2n1}-O)_x-C_{n2}H_{2n2}-OH]_m \qquad \text{IV.}$$

wherein x, m, $n_1$ and $n_2$ and $-OC_{n2}H_{2n2}OH$ are as above.

Especially preferred compounds within this group have the formula:

$$HO-\underset{\underset{CH_3}{|}}{CH}-CH_2-O-(C_{n3}H_{2n3}-O)_x-CH_2-\underset{\underset{CH_3}{|}}{CH}-OH \qquad \text{V.}$$

wherein $n_3$ is 2 or 3, and when $n_3$ is 3 the $C_{n3}H_{2n3}$ group is branched chain propylene, and x is as above.

These compounds are easily prepared by reacting in one or more steps ethylene oxide, propylene oxide and butylene oxide, either separately or in admixture. If the compound is terminated with a hydroxyethyl group, then the propylene or butylene oxide is added to convert the terminal hydroxyethyl group to a hydroxypropyl or hydroxybutyl group.

The process of the invention is applicable to any synthetic silicate-containing mineral wool fibrous material. The term "synthetic silicate containing mineral wool fibers" refers to mineral wool fibrous material prepared by melt spinning, melt blowing, or other mechanical spinning method, from molten glass, slag, mixed silicates, silicate rock or ore, or other silicate-containing material. The mineral wool fibers can be of any length, whether short or long, and of any diameter, whether fine or coarse.

Fibrous materials in accordance with the invention can be prepared by slurrying mineral wool fibers and cellulose fibers in a weight ratio of mineral wool fibers to cellulose fibers within the range from about 3:7 to about 10:1 in water or other inert liquid and then laying or drawing down the fibers from the slurry in the form of a fibrous layer on a porous carrier such as, for example, a wire gauze, such as a Fourdrinier wire. While the fibrous material is normally in the form of a sheet, it can be put in any desired form during laydown or drawdown, using, for example, a mold of the selected shape, removing at least part of the water through a porous mold. After laydown or drawdown, the fibrous layer is dried.

During the drying, the fibrous layer is impregnated with the polyoxyalkylene ether alcohol of the invention by, for example, dipping the layer in a tank containing an aqueous solution or dispersion thereof or by spraying the aqueous solution or dispersion onto the fibrous layer over a vacuum box. The ether alcohol can also be added neat, as is, although aqueous solutions are preferred, especially those containing at least 30% by weight of the polyoxyalkylene ether alcohol.

The amount of polyoxyalkylene ether alcohol added to the fibrous layer is normally within the range from about 1 to about 30% by weight of the fibrous material, and preferably within the range from about 2 to about 20% by weight of the fibrous material. Fibrous layers containing amounts of cellulose fibers in the upper portion of the stated range require more polyoxyalkylene ether alcohol than layers containing small amounts of cellulose fibers.

In addition to the polyoxyalkylene ether alcohol, plastic material and blowing agents as well as other adjuncts conventionally added to coating compositions of this type can be present. Exemplary additives include the cationic surface-active agents, which can improve the uniformity of distribution in water in soluble or dispersible components in the applying solution or dispersion. Other adjuncts include bonding agents, fillers and thickeners. Bondinng agents are used in cases where the affinity of the applied materials to the fibrous material is not sufficiently great to ensure good adhesion.

Exemplary fillers include micronized fuller's earth, clay, bentonite, and other finely-divided inorganic material, which should be chemically inert to the mineral fibers and to cellulose fibers.

Thickeners such as water-soluble cellulose ethers and starches and starch derivatives can be employed to increase the consistency of the coating dispersion or solution, and improve handling during processing of the coated fibrous material.

The following Examples in the opinion of the inventors represent preferred embodiments of the invention:

EXAMPLES 1 TO 4

A fibrous sheet composed of 21% by weight cellulose fibers and 49% by weight synthetic silicate-containing mineral wool fibers, and containing 30% by weight of a bonding agent, was impregnated with the polyoxyalkylene ether alcohol noted in Table I below in a pick-up calculated as dry ether alcohol of about 8% by weight of the fibrous material. The application was effected by soaking the fibrous material in an aqueous solution of the polyoxyalkylene ether alcohol. The impregnated fibrous material was then air-dried at 20° C.

A plastisol compound of 55% by weight polyvinyl chloride polymer, 43% by weight dioctyl phthalate, 1.1% by weight azodicarbonamide as a blowing agent, and 1.1% by weight zinc oxide as an accelerator, was then coated on the dried fibrous material to form a layer about 0.6 mm thick. The coated fibrous sheet was pregelatinized in a Werner-Mathis oven at 145° C. for three minutes. The heated fibrous material was then stored for one day at 20° C.

Then, selected portions of the coated material were coated with an inhibitor solution composed of a 6% solution of trimellitic acid anhydride, dissolved in methyl ethyl ketone. The coated material was then placed in an oven at 145° C., and held there for two minutes, and then withdrawn and allowed to stand for fifteen minutes. The material was then reintroduced into the oven at 200° C. and was held there for 1.5 minutes, resulting in a blowing of the plastic coating.

After the blown plastic coated fibrous material had cooled to room temperature, the quality of the coating was evaluated as to depth and the sharpness of the relief, and the number of coarse blisters over a cross-section 1 cm×1 cm of the plastic layer was noted. The evaluation of the depth and sharpness of the relief pattern was based on a rating scale ranging from 1 to 5, and corresponding to the following ratings:

| Number | Rating |
|---|---|
| 1 | Very poor |
| 2 | Poor |
| 3 | Fair |
| 4 | Good |
| 5 | Very good |

The results obtained are noted in Table I.

TABLE I

| Example | Dimension-stabilizing compound | Relief Depth | Relief Sharpness | Number of coarse blisters |
|---|---|---|---|---|
| 1 | Propoxylated polyethylene glycol (1 mole $H(OC_2H_4)_8OH$ + 4 moles propylene oxide) $H\text{-}[OCH(CH_3)\text{-}CH_2]_{n_4}\text{-}(C_2H_4O)_8\text{-}[CH_2CH(CH_3)O\text{-}]_{4-n_4}H$ ($n_4$ = 1 to 4, to a total of 4) | 4 | 4 | 70 |
| 2 | Propoxylated polyethylene glycol (1 mole $H(OC_2H_4)_8OH$ + 8 moles propylene oxide) $H\text{-}[OCH(CH_3)CH_2]_{n_5}\text{-}(C_2H_4O)_8\text{-}[CH_2\text{-}CH(CH_3)\text{-}O]_{8-n_5}H$ ($n_5$ = 1 to 8, to a total of 8) | 5 | 5 | 35 |
| 3 | Ethoxylated and then propoxylated ethanol (1 mole $C_2H_5OH$ + 8 moles ethylene oxide + 2 moles propylene oxide) $(C_2H_5O)(CH_2CH(CH_3)O)_{n_6}(C_2H_4)_8\text{-}(CH_2CH(CH_3)O)_{2-n_6}H$ ($n_6$ = 1 or 2 to a total of 2) | 4 | 4 | 70 |
| 4 | Propoxylated glycerol (1 mole | 5 | 5 | 30 |

TABLE I-continued

| Example | Dimension-stabilizing compound | Relief Depth | Relief Sharpness | Number of coarse blisters |
|---|---|---|---|---|
| | glycerol + 8 moles propylene oxide) $CH_2O(CH_2\underset{\underset{CH_3}{\vert}}{CHO})_{n7}H$ \| $CHO(CH_2\underset{\underset{CH_3}{\vert}}{CHO})_{n8}H$ \| $CH_2O-CH_2-\underset{\underset{CH_3}{\vert}}{CHO})_{n9}H$ ($n_7$, $n_8$ and $n_9$ = 1 to 8, to a total of 8) | | | |
| Control | $HO(-C_2H_4O)_8H$ | 2 | 2 | 115 |

It is apparent from these results that a deeper and sharper relief coating is obtained using the polyoxyalkylene ether alcohol of the invention than with the Control, polyoxyethylene glycol having eight oxyethylene units. Moreover, the plastic coating had a smoother surface on the fibrous material of the invention, and a smaller number of coarse blisters, representing broken cells in the foam.

Having regard to the foregoing disclosure, the following is regarded as patentable and inventive embodiments thereof:

1. A fibrous material comprising cellulose fibers and mineral wool fibers in a weight ratio within the range from about 3:7 to about 10:1, and an amount within the range from about 1 to about 30% by weight based on the total weight of the cellulose fibers and mineral wool fibers in the fibrous material, the amount being sufficient to impart dimensional stability thereto, of a water-soluble polyoxyalkylene ether alcohol having the formula:

$$R_1[-O-(C_{n1}H_{2n1}-O)_x-C_{n2}H_{2n2}OH]_m$$

wherein:

$R_1$ is selected from the group consisting of hydrocarbon and hydrocarbon substituted with secondary hydroxyl groups and free from primary hydroxyl groups and having from one to about twenty-four carbon atoms;

m is a number within the range from 1 to about 6;

$n_1$ is a number within the range from about 2 to about 4;

$n_2$ is a number within the range from 3 to 4; and $-C_{n2}H_{2n2}-OH$ is a branched chain propylene or butylene group having only secondary OH groups; and the total of x in all of the m groups (x multiplied by m) is a number within the range from about 2 to about 200.

2. A fibrous material according to claim 1, in which the amount of polyoxyalkylene ether alcohol is within the range from about 2 to about 20% by weight based on the total weight of the cellulose fibers and mineral wool fibers in the fibrous material.

3. A fibrous material according to claim 1, in which x is within the range from about 6 to about 50, and m within the range from 1 to about 4.

4. A fibrous material according to claim 1, in which the polyoxyalkylene ether alchol has the formula:

$$R_1-O-(C_{n1}H_{2n1}-O)_x-CH_2-\underset{\underset{CH_3}{\vert}}{CH}-OH$$

wherein $R_1$, $n_1$ and x are as in claim 1.

5. A fibrous material according to claim 1, in which the polyoxyalkylene ether alcohol has the formula:

$$R_1[O-(\underset{\underset{CH_3}{\vert}}{CH_2CH}-O-)_xCH_2\underset{\underset{CH_3}{\vert}}{CH}-OH]_{m1}$$

wherein:

$m_1$ is a number within the range from 3 to 6;

$R_1$ is derived from a polyol having at least three up to about six hydroxyl groups, and the $R_1$ group when containing hydroxyl groups has only secondary hydroxyl and no primary hydroxyl groups; and x is as above.

6. A fibrous material according to claim 5, in which the polyol is glycerol.

7. A fibrous material according to claim 1, in which the polyoxyalkylene ether alcohol has the formula:

$$HO-C_{n2}H_{2n2}-[O-(C_{n1}H_{2n1}-O)_x-C_{n2}H_{2n2}-OH]_m$$

wherein x, m, $n_1$ and $n_2$ and $-OC_{n2}H_{2n2}OH$ are as in claim 1.

8. A fibrous material according to claim 1, in which the polyoxyalkylene ether alcohol has the formula:

$$HO-\underset{\underset{CH_3}{\vert}}{CH}-CH_2-O-(C_{n3}H_{2n3}-O)_x-CH_2-\underset{\underset{CH_3}{\vert}}{CH}-OH$$

wherein $n_3$ is 2 or 3, and when $n_3$ is 3 the $C_{n3}H_{2n3}O$ group is branched chain propylene, and x is as in claim 1.

9. A fibrous material according to claim 1, in which the fibrous material is coated with a plastic material.

10. A fibrous material according to claim 9 in which the plastic material is a thermoplastic synthetic polymer derived from a vinyl monomer.

11. A fibrous material according to claim 10 in which the vinyl monomer is selected from the group consisting of vinyl chloride, vinyl acetate, vinylidene chloride and mixtures thereof.

12. A fibrous material according to claim 10 in which the thermoplastic polymer is polyvinyl chloride.

13. A fibrous material according to claim 12 in which the polyvinyl chloride coating is prepared from a polyvinyl chloride plastisol containing a plasticizer in a weight ratio polymer: plasticizer within the range from about 2:3 to about 5:1.

14. A fibrous material according to claim 13 in which the polyvinyl chloride coating comprises a blowing agent.

15. A fibrous material according to claim 14 in which a portion of the coating carries a blowing inhibitor inhibiting blowing in that portion, thus giving a relief pattern on the blown coated fibrous material.

16. A fibrous material according to claim 14 in which the coating comprises an accelerator for the blowing.

* * * * *